US009700198B1

(12) United States Patent
Olson

(10) Patent No.: US 9,700,198 B1
(45) Date of Patent: Jul. 11, 2017

(54) AUXILIARY SPRAYER ATTACHMENT

(71) Applicant: George T. Olson, Wichita, KS (US)

(72) Inventor: George T. Olson, Wichita, KS (US)

(73) Assignee: itrio Global, L.L.C., Wichita, KS (US)

( * ) Notice: Subject to any disclaimer, the term of this patent is extended or adjusted under 35 U.S.C. 154(b) by 0 days.

(21) Appl. No.: 14/635,737

(22) Filed: Mar. 2, 2015

(51) Int. Cl.
*A47L 17/04* (2006.01)
*E03C 1/04* (2006.01)
*A47L 17/08* (2006.01)

(52) U.S. Cl.
CPC ..... *A47L 17/04* (2013.01); *A47L 17/08* (2013.01); *E03C 1/0404* (2013.01)

(58) Field of Classification Search
CPC combination set(s) only.
See application file for complete search history.

(56) References Cited

U.S. PATENT DOCUMENTS 4,332,250 A * 6/1982 Behney ..... A61D 11/00 401/282
4,674,903 A * 6/1987 Chen ..... A45D 34/04 401/183
6,571,419 B1 * 6/2003 Lee ..... A47L 1/06 15/210.1
8,342,768 B1 * 1/2013 Johnston ..... B05B 1/18 401/282
2013/0125430 A1 * 5/2013 Whittemore ..... G09F 3/02 40/299.01
2013/0248010 A1 * 9/2013 Reiman ..... A47L 17/00 137/315.01

* cited by examiner

*Primary Examiner* — David Walczak
(74) *Attorney, Agent, or Firm* — Kenneth H. Jack; Davis & Jack, L.L.C.

(57) ABSTRACT

An auxiliary sprayer attachment including a toroidal scrub pad incorporating an annular inner surface, the annular inner surface having first helical threads; and a tubular conduit having a rearward end and a forward output end, the tubular conduit's forward output end having an annular outer surface having second helical threads, the second helical threads radially outwardly impinging against and forming the annular inner surface's first helical threads; and further incorporating a conically bored sleeve wall for pressure fitted interconnection with the sprayer.

4 Claims, 6 Drawing Sheets

AUXILIARY SPRAYER ATTACHMENT

FIELD OF THE INVENTION

This invention relates to surfaces scrubbing and washing implements. More particularly, this invention relates to such implements which are attachable to a sprayer or nozzle as an auxiliary component.

BACKGROUND OF THE INVENTION

Auxiliary pot, pan, glass, and dish scrubbing implements which are adapted for attachment to a sprayer such as a common kitchen sink sprayer are known. Drawbacks and functional deficiencies which are commonly associated with or are experienced during the use of such known auxiliary implements include insecure receipt and support of scrub pad components, and include difficulties in effectively cleaning pathogen laden dirt and debris from the pad's attachment or mounting support surfaces. As a result of such cleaning difficulties, undesirable growths of pathogens upon the pad components occurs, undesirably increasing health hazard risks.

The instant inventive auxiliary sprayer attachment solves or ameliorates the problems, difficulties, and deficiencies described above by incorporating within the attachment specialized pad support and connecting structures which securely support the pad element during scrubbing use, which provide for ease of interchangeability and reconfiguration of pads, and which facilitate easy and thorough cleaning of pad attachment surfaces.

BRIEF SUMMARY OF THE INVENTION

A first structural component of the instant inventive auxiliary sprayer attachment comprises a toroidally configured scrub pad. The toroidal scrub pad necessarily presents an annular inner surface which preferably presents radially inwardly extending helical threads which are defined by elastically extendable and retractable thread valleys.

In a preferred embodiment, the toroidal scrub pad component of the invention is substantially shaped as a circular disk, and the pad's annular inner surface comprises a substantially circularly cylindrical aperture which extends axially through the disk.

A further structural component of the instant inventive auxiliary sprayer attachment comprises a preferably plastic tubular conduit having a rearward water input end and a forward water output end. In the preferred embodiment, the tubular conduit's forward output end has an annular outer surface, such surface having and presenting second helical threads which are relatively permanent and which extend radially outwardly. In the preferred embodiment, such second helical threads mechanically mold or form the scrub pad's first helical threads by means of radially outwardly directed compressive contact with or impingements against the scrub pad's relatively elastic annular inner surface.

The instant inventive auxiliary attachment is preferably adapted for use with and for removable attachment to a nozzle end of a common kitchen sink sprayer, and may suitably be alternatively configured for attachment to the helically threaded output nozzle or sprayer of a common garden hose. Accordingly, in addition to structural components described above, the instant invention preferably comprises means for removably mounting the tubular conduit's rearward input end upon the nozzle portion of such sink or hose sprayer. In a preferred embodiment, the removable mounting means incorporate a conically bored configuration of the inner wall of the rearward input end of the tubular conduit, such conical bore preferably functioning as a pressure fit sleeve joint which engages the typically conical outer profile of the nozzle portion of a common kitchen sink sprayer. Suitably, such mounting means may alternatively comprise an internally helically threaded coupling nut or fastener of the type which is commonly engageable with the threads of the output nozzle of a common garden hose.

In a preferred embodiment of the instant inventive auxiliary sprayer attachment, the toroidally configured scrub pad component comprises a multiply layered strata of materials selected from the group consisting of polyurethane artificial sponge, cellulose artificial sponge, natural sponge, metal strand mesh, plastic fiber mesh, natural fiber mesh, woven fibers, natural loufa, and synthetic loufa. Where the scrub pad component is configured to include such strata of materials, the strata preferably consists of a first stratum and a second stratum. Such provision of first and second stratums enables pad reversibility, such dually positionable pad advantageously allowing either of the two stratums to be positioned at the forward or output end of the pad. Where, as is preferred, the pad's stratums have differing levels of asperousness or roughness the pad may, through reverse positioning, be alternatively used for scrubbing heavy debris from dishes, pots, and pans, and for finer cleaning and wiping of dish, pot, and pan surfaces.

In the preferred embodiment, the tubular conduit component includes and presents an annular flange positioned rearwardly from the conduit's second helical threads, such annular flange advantageously providing backing or base support to the scrub pad during scrubbing use. Also, in the preferred embodiment, the tubular conduit comprises durable injection molded plastic.

In use of the instant inventive auxiliary sprayer attachment, and assuming the provisions of the preferred structures which are described above, a user may initially mount the assembled pad and conduit combination upon a common sink sprayer via a slightly twisting and rearwardly pressing extension of the tubular conduit's rearward conical bore over the sprayer's forward nozzle. Thereafter, the user may actuate the sprayer, causing water to pass forwardly through the conduit, and to emit from the central aperture of the toroidal scrub pad. Thereafter, the user may place the forward end of the pad into scrubbing contact with, for example, a dirty dish. Light and heavy scrubbing action may be alternatively facilitated by simply unscrewing, inverting, and re-attaching the toroidal scrub pad over the tubular conduit's helically threaded forward end.

While the toroidal scrub pad is removed from the tubular conduit, natural elasticity of the pad's stratum materials advantageously temporarily removes the valleys which define the first helical threads. Such elastic removal of the first helical threads aids and assists in thorough cleaning of the pad by temporarily eliminating the thread defining "V" shaped valleys which would otherwise harbor and shield from cleaning pathogen bearing dirt and debris.

To further assist in reduction of pathogens accumulating within the pad component, slow releasing biocides are preferably integrally incorporated within the pad.

Accordingly, objects of the instant invention include the provision of an auxiliary sprayer attachment which incorporates structures, as described above, and which arranges those structures in relation to each other in manners described above for the performance of the beneficial functions described above.

Other and further objects, benefits, and advantages of the present invention will become known to those skilled in the art upon review of the Detailed Description which follows, and upon review of the appended drawings.

DETAILED DESCRIPTION OF A PREFERRED EMBODIMENT

Figure 1:
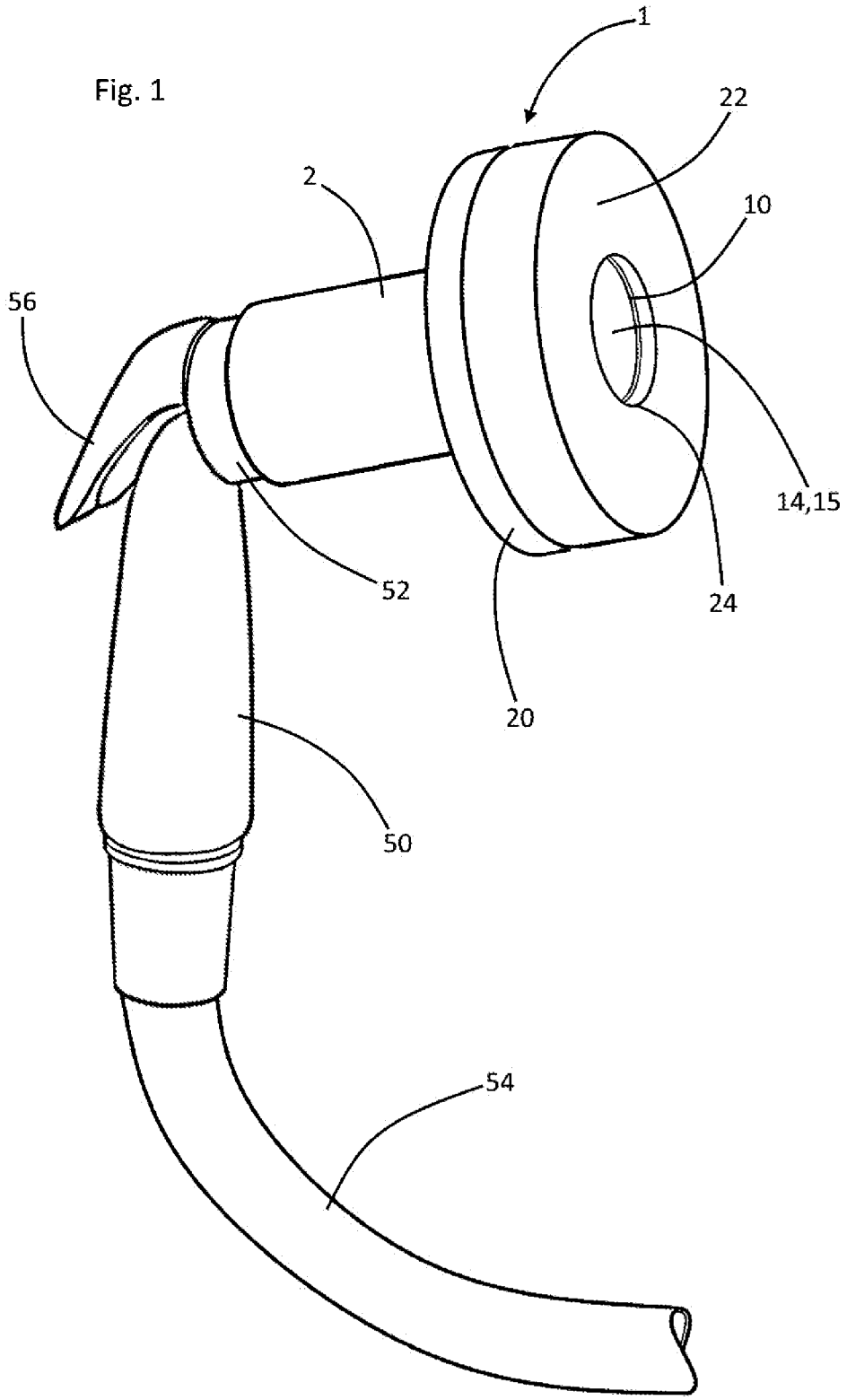
FIG. 1 is a perspective view of a preferred embodiment of the instant inventive auxiliary sprayer attachment, the view showing such attachment mounted upon a common sink sprayer.

Referring now to the drawings and in particular to Drawing FIG. 1, a preferred embodiment of the instant inventive auxiliary sprayer attachment is referred to generally by Reference Arrow 1. The auxiliary sprayer attachment 1 preferably comprises a toroidal scrub pad 20,22 having, referring further simultaneously to FIG. 6, an annular inner surface 27, such annular inner surface 27 forming and defining a cylindrical bore or channel 15 which extends axially through the pad 20,22. The scrub pad 20,22 preferably comprises a strata of layers or stratums consisting of the two layers depicted. In the preferred embodiment, the stratums 20 and 22 of the scrub pad 20,22 are composed of materials selected from the group consisting of polyurethane artificial sponge, cellulose artificial sponge, natural sponge, metal mesh, plastic fiber mesh, natural fiber mesh, woven fibers, natural loufa, and synthetic loufa. Such material selections have varying degrees or levels of roughness or asperousness supporting a choice of materials for the layers 20 and 22 wherein layer 20 comprises a relatively rough or course plastic fiber mesh and layer 22 comprises a relatively soft closed cell polyurethane artificial sponge. Upon such materials choice, layer 20 is beneficially capable of scrubbing heavy debris from pot and pan surfaces, while layer 22 is alternatively capable of fine or light duty scrubbing and wiping of surfaces. In a preferred embodiment, a durable, flexible, and waterproof adhesive layer 21 interposed between stratums 20 and 22 securely bonds those layers together to form the integral scrub pad component 20,22.

A further structural component of the instant inventive auxiliary sprayer 1 comprises, referring simultaneously to FIGS. 1 and 3-5, first helical threads 24, such threads residing at and extending radially inwardly from the wall of the pad's central channel 15. According to the operation and function of the instant inventive auxiliary sprayer attachment 1, the first helical threads 24 are formed and are temporarily elastically defined by relatively permanent second helical threads 12 which are either fixedly attached to or are formed wholly with the radially outer aspect of the forward output end 10 of a preferably plastic tubular conduit 2. Radially outwardly directed impingement and pressure exerted by the second helical threads 12 against wall surface 27 advantageously radially outwardly deflects portions of the annular surface 27 to form of the matrices of the pads 20 and 22 the first helical threads 24.

Figure 3:
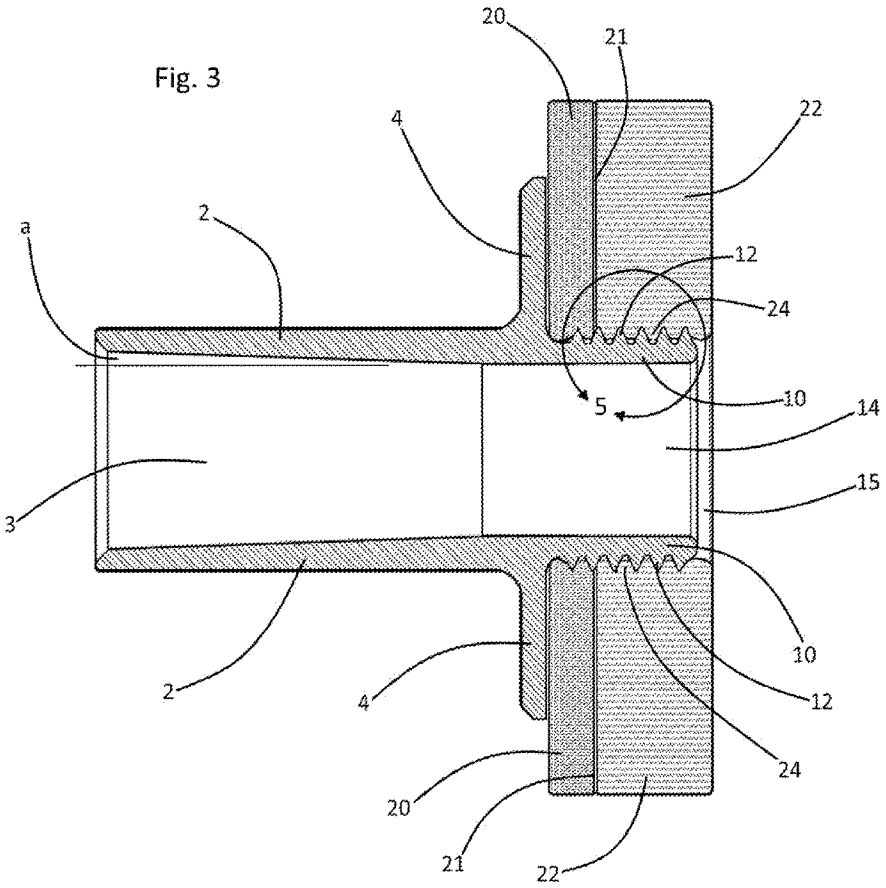
FIG. 3 is a sectional view as indicated in FIG. 2.
Figure 5:
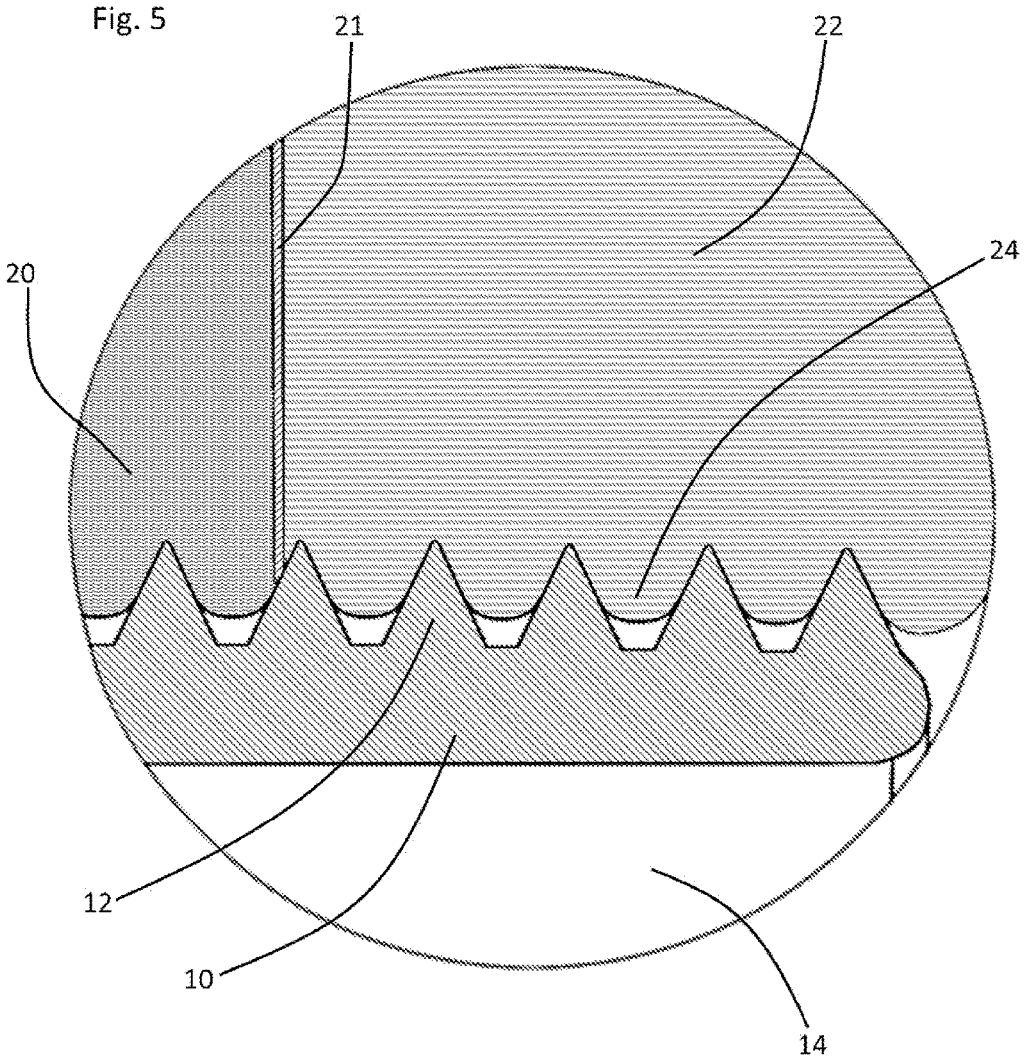
FIG. 5 is a magnified partial view as indicated in FIG. 3.
Figure 6:
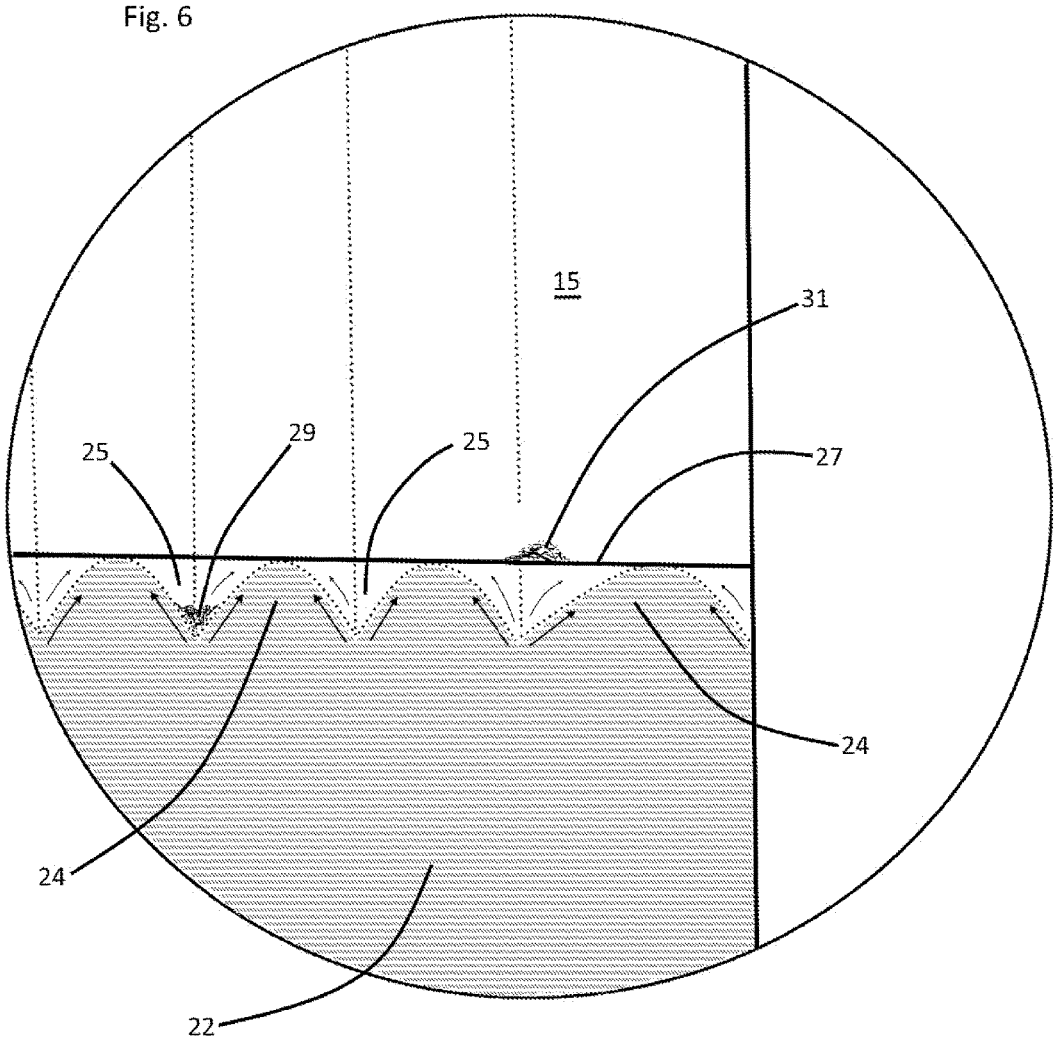
FIG. 6 is a magnified partial view as indicated in FIG. 4, the view showing a sponge matrix component moved to a surface cleaning facilitating configuration.

Referring in particular to FIG. 3, the tubular conduit 2 has a rearward input end 3, a forward output end 14, and has an annular pad backing and supporting flange 4. In use and operation of the pad 20,22 in conjunction with the tubular conduit 2, the pad 20,22 may initially be separate and disconnected from the tubular conduit 2. Referring further to FIG. 6, upon such disconnection, the annular wall of the bore 15 is elastically retained in a substantially smooth and cylindrical wall surface configuration consistent with surface 27. Upon placement of the rearward opening of channel 15 over the forward lip 10 of conduit 2, rearward pressure may be exerted while simultaneously rotating the pad 20,22 in the clockwise direction. Such pressure and rotation advantageously screws the pad 20,22 onto the tubular conduit 2. During such rotating pad attachment, the male second helical threads 12 advantageously form and define closely fitted female helical threads 24.

As is indicated in FIG. 6, such helical threads 24 inherently form and define helical "V shaped valleys 25 in which pathogen bearing debris 29 may undesirably grow and accumulate. Upon counter-clockwise unscrewing of the pad 20,22 from the second helical threads 12, the elastic nature of the internal matrices of the pad 20,22 normally moves the angled axial and oppositely axial faces of the helical threads 24 in the directions indicated by the arrows drawn upon FIG. 6. Such elastic rebound advantageously moves the threads 24 toward the orientation of the smooth and relatively flat wall 27. Pathogens and debris 29 undesirably accumulates within the valleys 29 between threads 24 and are difficult to thoroughly clean. In contrast, similar pathogens and debris 31 radially inwardly moved to the relatively smooth and flattened surface 27 are relatively easily cleaned and removed. Accordingly, the threads 24 constitute specialized components of the instant invention which advantageously carry debris and pathogens 29 to the inwardly exposed and easily cleanable position of the debris 31. The annular inner wall 27 of the toroidal pad 20,22 of the instant invention advantageously moves the angled walls of threads 24 upon conduit attachments and detachments between first and second positions, the first position constituting a helical thread forming position, and the second position constituting a radially inwardly deflections of the thread walls for facilitation of cleaning of debris and pathogens.

Where the stratums 20 and 22 of the pad 20,22 comprise plastic fiber matting or plastic closed cell foam, such pad materials preferably include an anti-microbial or pathogen reducing additive which is integrally molded within the pad's plastic matrix. In a preferred embodiment, such anti-microbial or pathogen reducing additive comprises an inorganic powder characterized by relatively small particle size between 1-2 micrometers. In a preferred embodiment, the anti-microbial additive constitutes a silver ion releasing chemical compound such as silver iodide. Other biocides commonly known to be integrally moldable within plastic matrices are considered to fall within the scope of the invention.

Figure 2:
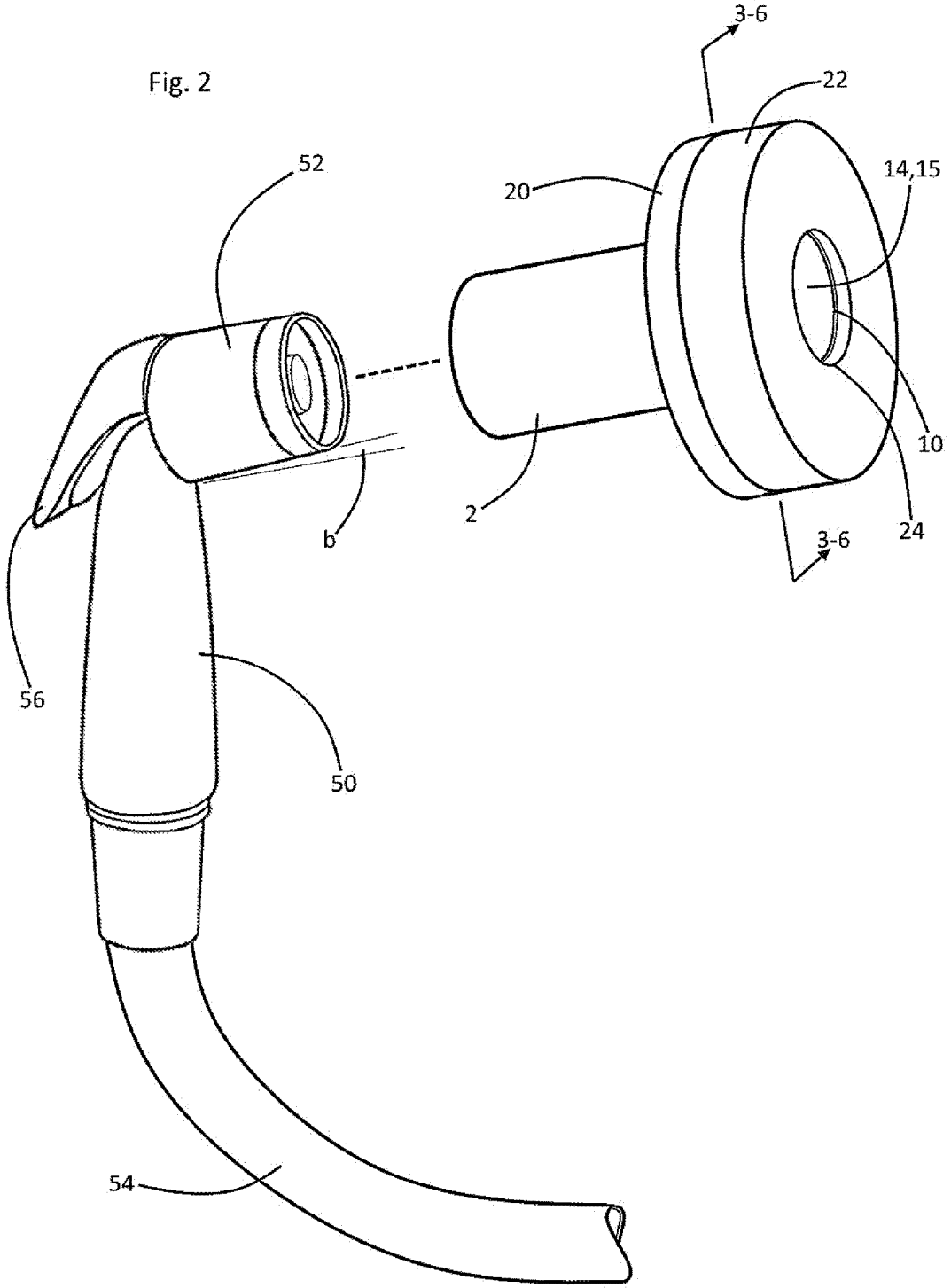
FIG. 2 is a partially exploded view of the structure of FIG. 1.

Referring simultaneously to FIGS. 1-3, the instant inventive auxiliary sprayer attachment 1 may be advantageously utilized in conjunction with a common sink sprayer 50, such sprayer having a water supply hose 54, a conically configured output nozzle 52, and an on/off valve actuating lever

56. The rearward input end 3 of the tubular conduit 2 preferably is conically bored at an angle "a", such angle preferably being slightly less than the conical angle b of the sprayer nozzle 52. Such preferred relationship of conical angles "a" and "b" assures that, upon rearward driving of the conduit 2 over the nozzle 52, localized plastic deflection and deformation of the annular inner wall of conduit 2 moves such conduit wall from its initial "a" angle orientation to an elastically flared orientation approximating the angle "b" of the nozzle 52. The conduit 2 is preferably composed of durable semi-elastic plastic in order to enhance such flaring conical sleeve mode of attachment.

Figure 7:
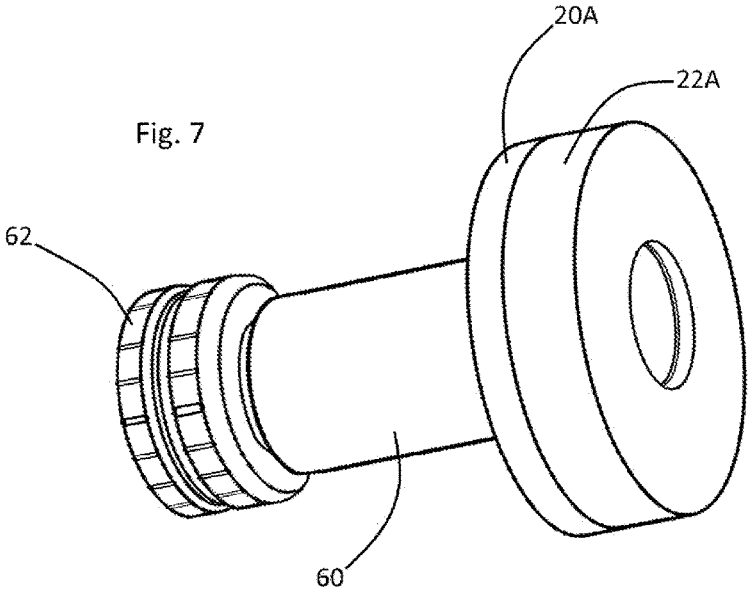
FIG. 7 is an alternate configuration of the attachment depicted in FIG. 2.
Figure 8:
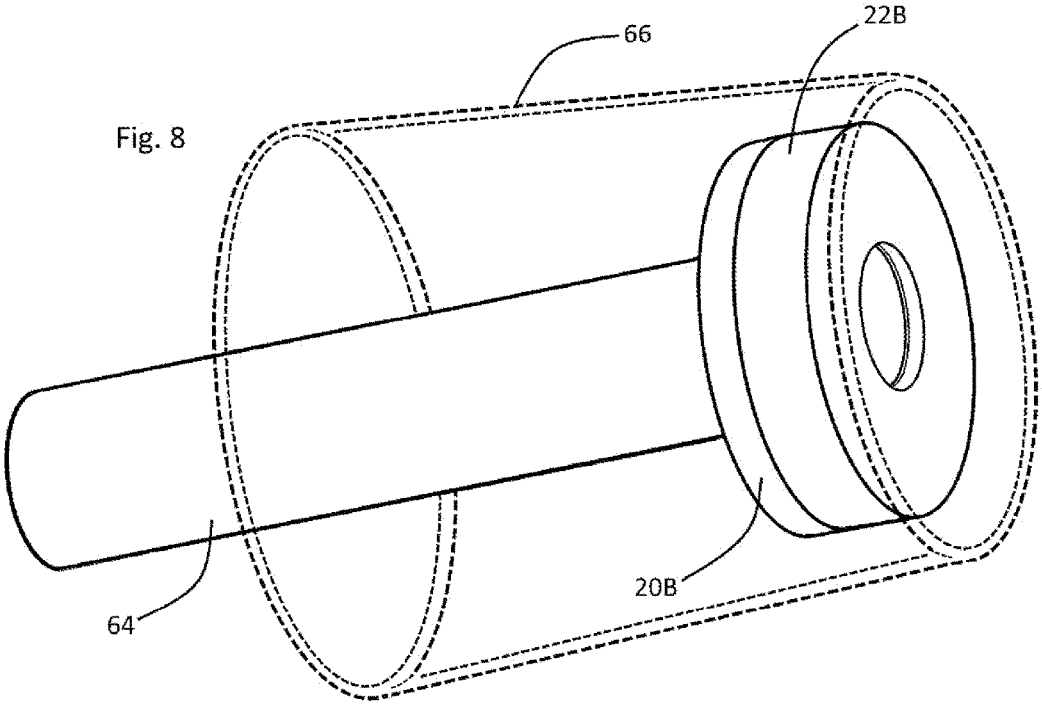
FIG. 8 presents a second alternate configuration of the attachment depicted in FIG. 2.

Referring simultaneously to FIGS. 1, 2, and 7, all reference numerals having the suffix "A" appearing in the alternate FIG. 7 configuration identify structures substantially identical to similarly numbered structures appearing in FIGS. 1 and 2. In the FIG. 7 structural alternative, conduit 60 includes a rearwardly positioned internally helically threaded coupling nut 62 of the type which threadedly engages the output nozzle of a common garden hose, such nozzle constituting an alternate sprayer configuration. In the FIG. 8 structural alternative, all structures identified by reference numerals having the suffix "B" are substantially identical to similarly numbered structures appearing in FIGS. 1 and 2. In the FIG. 8 alternate configuration, tubular conduit 64 is lengthened for assistance with extensions of the pad 20B,22B into cups or glasses 66 for cleaning of recessed surfaces.

Figure 4:
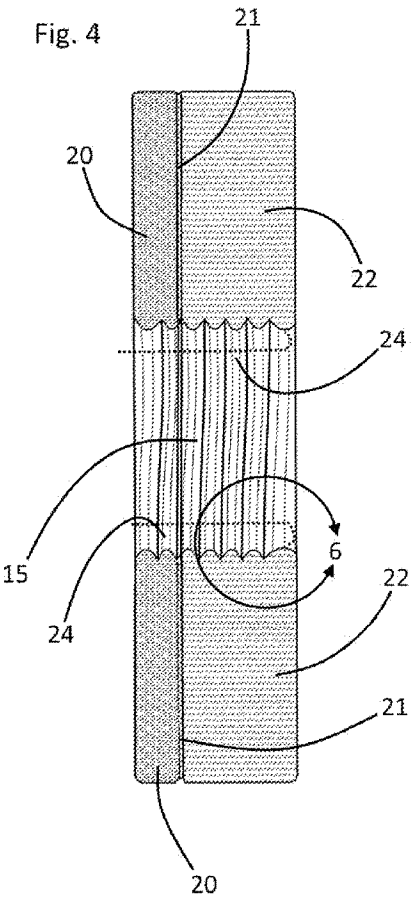
FIG. 4 is an alternate representation of the sectional view of FIG. 3, the view of FIG. 4 showing tubular conduit structures removed.

Referring to FIGS. 3 and 4, and assuming that pad stratum 20 is more asperous than or rougher than pad 22, the pad 20,22 may be advantageously inverted and attached to end 10 of tubular conduit 2 in an orientation opposite that depicted. Upon such inverted and alternate configuration, the rougher stratum 20 resides at the forward output end of the conduit 2 and provides enhanced dish, pot, and pan scrubbing capability.

While the principles of the invention have been made clear in the above illustrative embodiment, those skilled in the art may make modifications in the structure, arrangement, portions and components of the invention without departing from those principles. Accordingly, it is intended that the description and drawings be interpreted as illustrative and not in the limiting sense, and that the invention be given a scope at least commensurate with the appended claims.

The invention hereby claimed is:

1. An auxiliary sprayer attachment comprising:

(a) a toroidal scrub pad having an annular inner surface, said annular inner surface having first helical threads; and (b) a tubular conduit having a rearward input end and a forward output end, said conduit's forward output end having an annular outer surface having second helical threads, the second helical threads forming the first helical threads; and (c) a fastener selected from the group consisting of a conically bored sleeve and a helically threaded coupler, the fastener removably mounting the tubular conduit's rearward input end upon the sprayer; wherein the toroidal scrub pad comprises a strata of materials selected from the group consisting of polyurethane artificial sponge, cellulose artificial sponge, natural sponge, metal mesh, plastic fiber mesh, natural fiber mesh, woven fibers, natural loufa and synthetic loufa.

2. The auxiliary sprayer attachment of claim 1 wherein the materials strata comprises a first stratum and a second stratum, wherein the toroidal scrub pad's annular inner surface has an output end and has an end opposite from the output end, and wherein the first and second stratums are alternatively positionable at said surface's output end.

3. The auxiliary sprayer attachment of claim 2 further comprising an annular flange fixedly attached to or formed wholly with the tubular conduit, the annular flange being positioned rearwardly from the second helical threads.

4. The auxiliary sprayer attachment of claim 3 wherein the tubular conduit is composed of injection molded plastic.

* * * * *